US005263902A

United States Patent [19]

Jones

[11] Patent Number: 5,263,902

[45] Date of Patent: Nov. 23, 1993

[54] EASILY DISASSEMBLED TRACKLESS ROUNDABOUT

[76] Inventor: George D. Jones, 9210 5th St., Lanham, Md. 20706

[21] Appl. No.: 907,012

[22] Filed: Jul. 1, 1992

[51] Int. Cl.[5] ..... A63G 1/12

[52] U.S. Cl. ..... 472/21

[58] Field of Search ..... 472/21, 19, 26, 29, 472/24; 104/53; 482/57, 61

[56] References Cited

U.S. PATENT DOCUMENTS

| | | | |
|---|---|---|---|
| 724,672 | 4/1903 | Culver | 472/21 X |
| 1,639,393 | 8/1927 | Woodruff | 472/21 |
| 2,533,368 | 12/1950 | Hansen et al. | 472/21 X |
| 2,564,542 | 8/1951 | Milbourn | 104/53 |
| 3,642,275 | 2/1972 | Ellico | 104/53 X |

FOREIGN PATENT DOCUMENTS

| | | | |
|---|---|---|---|
| 1039398 | 10/1953 | France | 472/21 |

*Primary Examiner*—Carl D. Friedman
*Assistant Examiner*—Kien Nguyen
*Attorney, Agent, or Firm*—Robert Halper

[57] ABSTRACT

A roundabout adapted for play or exercise in the yard using one or a plurality of bicycles secured by top and bottom mounting assemblies to a mounting post rotatable about a fixed post solidly implanted in the ground. The bike or bikes are fastened to mounting assemblies by straps and can be readily disassembled by simply unbuckling the straps. The ground post can be removed and the same placed in another area of the yard. Motive power is supplied by a small wheel placed exteriorly of the front bike wheel and fastened on the bottom mounting assembly.

8 Claims, 2 Drawing Sheets

FIG. 1
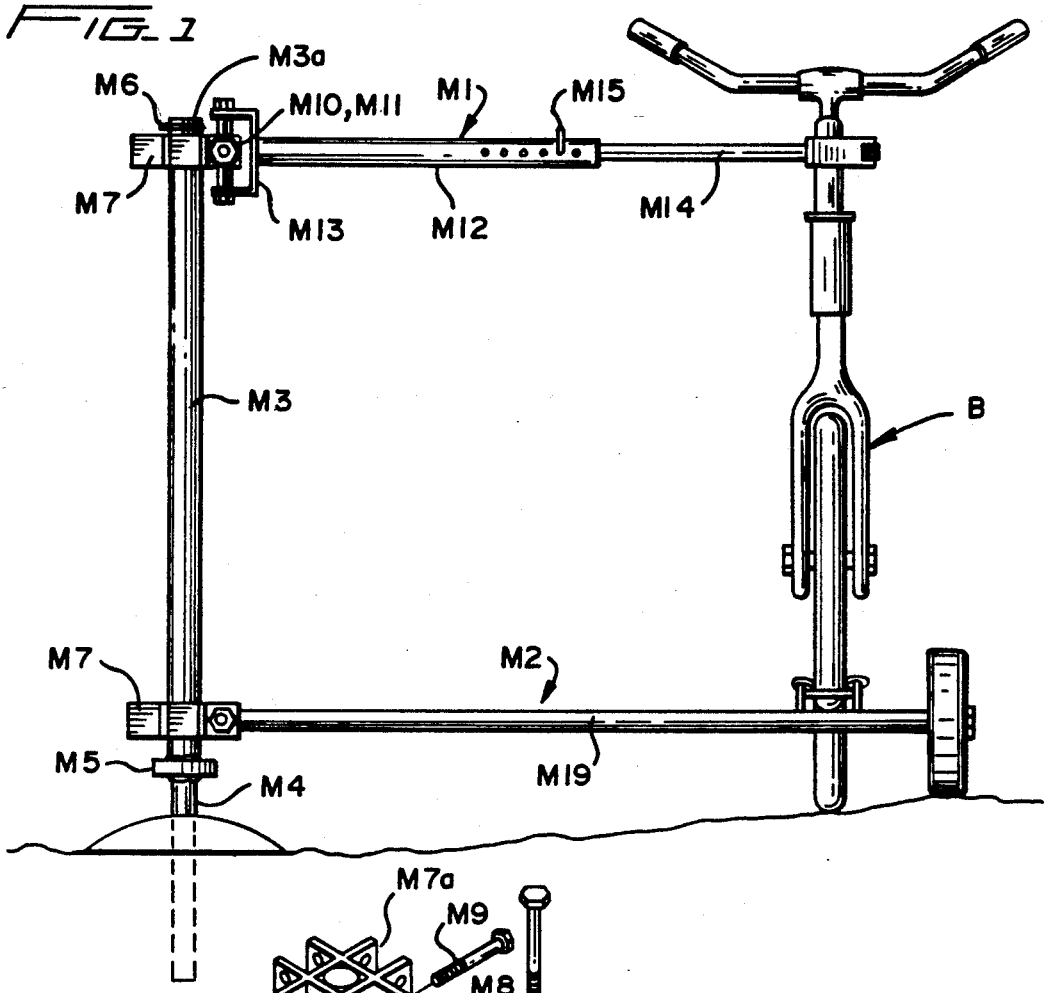
FIG. 3
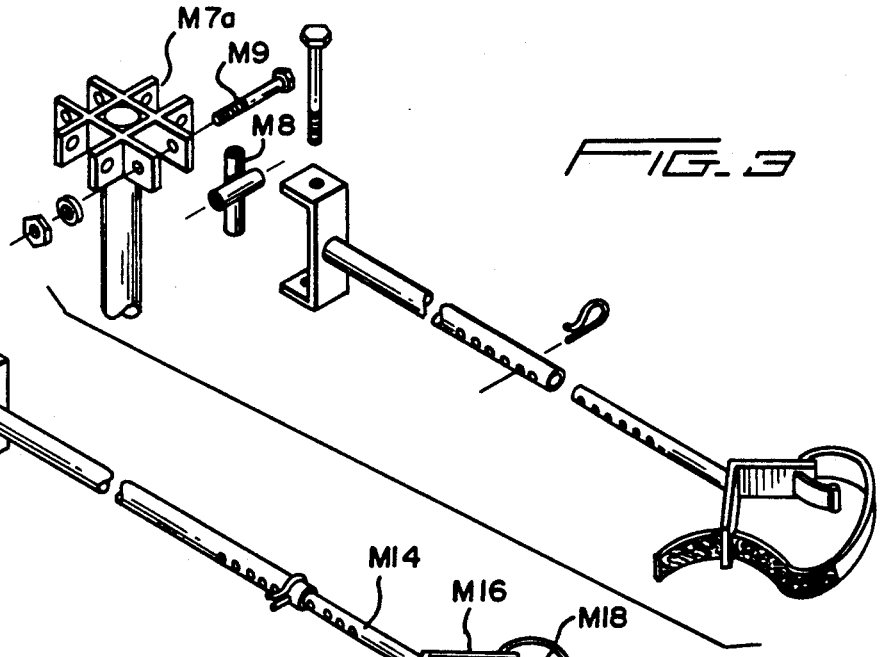
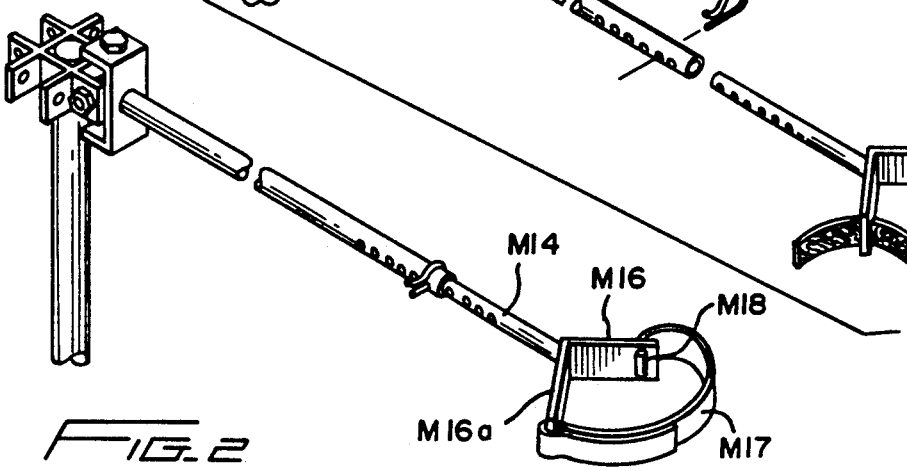
FIG. 2

EASILY DISASSEMBLED TRACKLESS ROUNDABOUT

This invention is concerned with the type of device known as a roundabout. The art shows a number of these devices which have been in existence for a number of years. Exemplary of the art are U.S. Pat. Nos. 345,414, 462,295, 1,639,393, 2,539,161, 3,235,252, 3,672,669, Canadian patent 701,559 and U.S. Pat. Nos. Des. 174,173 and 287,262. The apparatus presented herein in this specification is a distinct improvement over the prior art. Unlike most of the cited devices, this invention employs a standard type bicycle, adapted for use in the yard. The apparatus herein can employ either one or a multiple number of bikes. By employing both the top and bottom mounting assembly, the device is very stable and secure against overturning. A special track is not required and the motive power for rotating the roundabout about a centrally located mounting post is furnished by a small wheel mounted exteriorly of the bike wheel and attached to the lower mounting assembly. When not in use the bikes can be readily disassembled and taken inside the house.

BRIEF DESCRIPTION OF THE DRAWINGS

FIG. 1 is a front view showing the attachment by the mounting assemblies of one unit to the mounting post.

FIG. 2 is a perspective view of the top assembly.

FIG. 3 is a perspective view of the top assembly showing attachments of a universal sleeve to a bracket on the mounting post and attachments of a stabilizer tube to a universal sleeve and attachment of a yoke tube to the stabilizer tube and installation of a fastening strap.

DESCRIPTION OF THE PREFERRED EMBODIMENT

Figure 4:
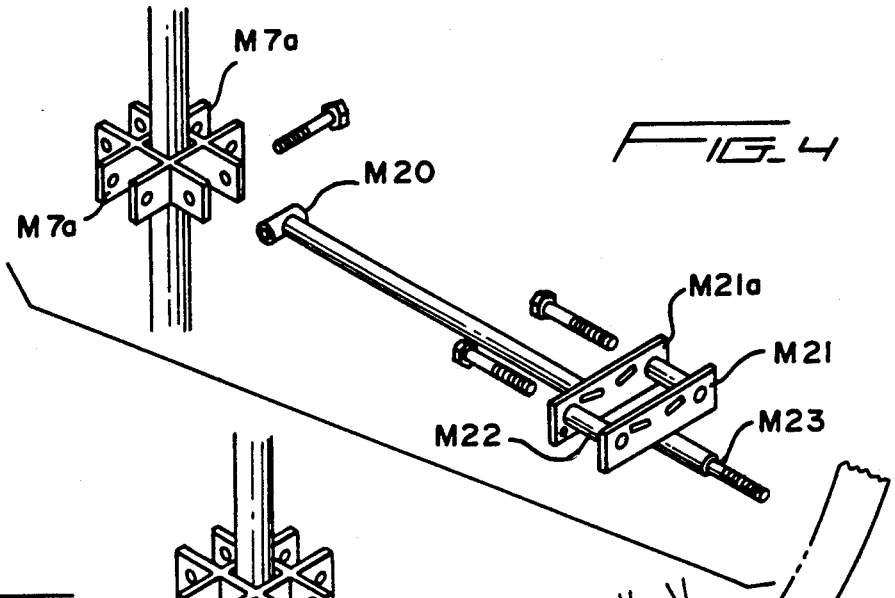
FIG. 4 is perspective view of the bottom assembly
Figure 5:
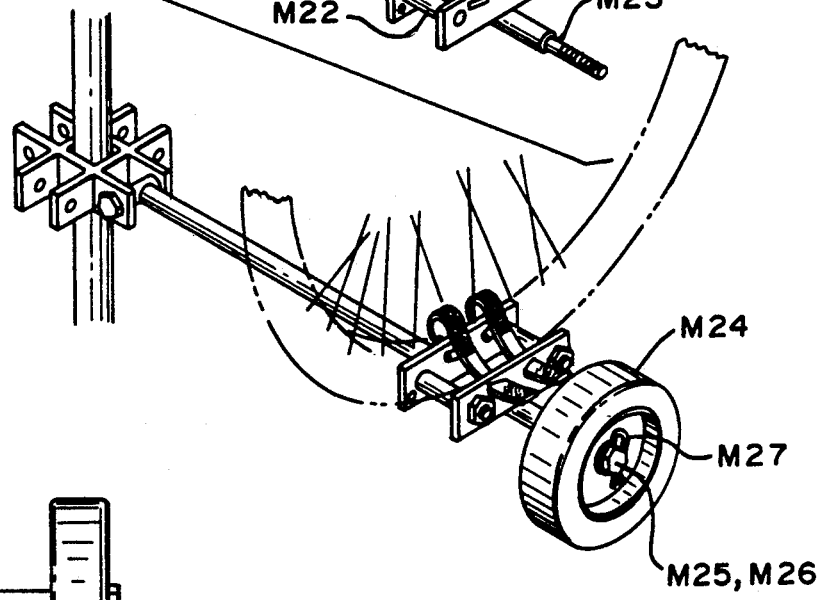
FIG. 5 is another perspective view of the bottom assembly including a small wheel and wherein part of the assembly is put together.
Figure 6:
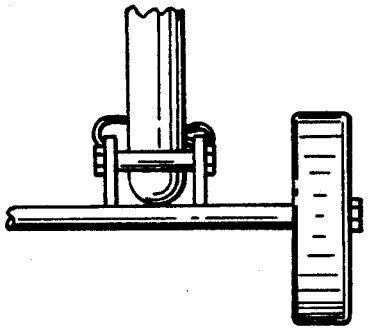
FIG. 6 is a front view showing the wheel attached to the bottom assembly.
Figure 7:
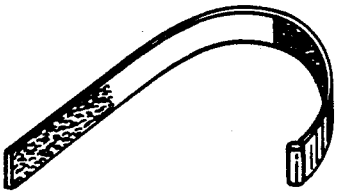
FIG. 7 is a perspective view showing the straps used to fasten the bike on both the top and bottom assemblies.
Figure 8:
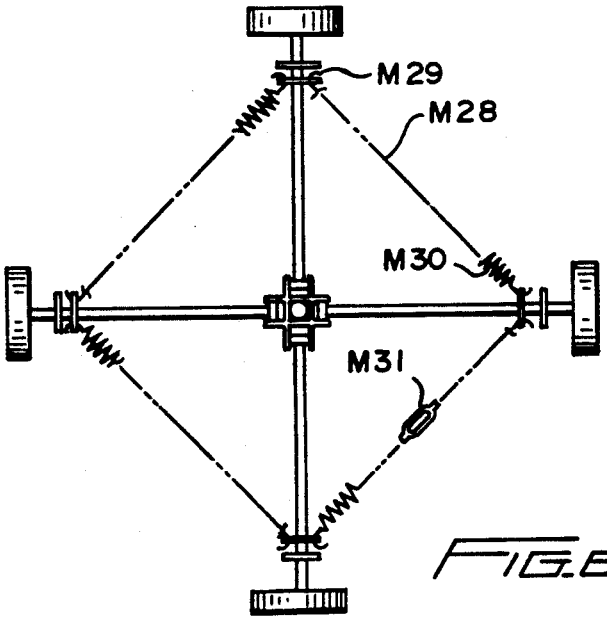
FIG. 8 is a plan view showing the use of four bikes and attachment of four cables arranged as a parallelogram.

With respect to FIG. 1 there is shown a bicycle B having top and bottom mounting assemblies M1, M2 respectively for connecting the bicycle to a mounting post M3. The post is made of steel tubing and has a 2 1/32" I.D. It fits over another post M4 of similar tubing and 2" O.D. which is driven into the ground to a depth of 2 feet. The post M4 extends above the ground about 34". Welded around this post at the end that projects above the ground is a bearing collar M5. Post M3 fits over M4 down to the bearing collar and post M3 extends about 34" above the ground. Near the top of the mounting post is an aperture. An apertured cap M3*a* fits into the post with the apertures aligned and a cotter pin M6 passes through the apertures to secure the cap to the post. Just below the cap attachment is a crate-like bracket M7 made of channel-like plates M7*a*. Each plate is welded to its adjacent plate at the juncture of the flanges of the plates. The flanges measure 1⅜" in length and the depth of the web is 2" I.D. Similarly a crate-like bracket is located near the lower end of the mounting post so that the center of the web is 2½" from the ground. In the center of each flange of the channel-like plates is located a ¼" diameter hole. M8 is a universal bearing and comprises two ¼" I.D. tubes each 2" long and welded together at their mid sections to form a cross with the horizontal leg being positioned between the flanges of the bent plate and in alignment with the holes. The horizontal tube is secured by passing threaded bolt M9 through the horizontal tube and securing the same with a lock washer M10 and nut M11. M12 is a stabilizer tube which is 86" long, one end is fitted to a channel-like plate M13 similar to the aforementioned plates except for having a 13/16" I.D. hole in the web between the two flanges into which the stabilizer tube is placed and welded to the web of the plate. The stabilizer tube has about five spaced perforations near the end opposite the juncture to the bent plate. A tubular horizontal member M14 is about 16" in length 11/16" O.D. and has spaced perforations similar to those in the stabilizer tube. It is adjustably connected to the horizontal stabilizer by means of a quick pin M15. Extending from the horizontal portion of the tube is a yoke M16 made of angular plates M16*a* with legs 1⅜" long and 1" in height. At the point where the legs join, the horizontal tube is welded. Each leg has a slot ¾" long ⅜" wide and spaced about ½" from the respective outer ends of the legs. Passing through these slots is a fastening strap M17 of the hook and loop type made of material sold under the Trademark "Velcro". One end of the strap is fitted with a buckle M18. The bottom mounting assembly is similar to the top however the mounting bar M19 is longer than the top mounting assembly and has a tubular sleeve M20 welded for attachment to the post M4 by way of the crate-like structure heretofore described. The sleeve fits into the two apertured flanges and is held in place as in the top mounting assembly by a bolt, lock washer and nut. At the other end of the mounting bar and in alignment with the channel-like plate of the yoke tube of the upper mounting assembly is a bracket M21. The bracket consists of two spaced bars M21*a* 6" long by 1⅜" high and ¼" thick. On both ends of the bars ½" from the top edge and ¾" from the sides there are two ¼" apertures. Similarly ½" from the bottom edges and ⅝" from the sides are two ¼" apertures. Two spaced slots about 1" long and 3/16" wide are arranged diagonally such that the top most edge of each slot is ½" from the top of the bar and the bottom edge is 1⅜" from the sides. This bracket is welded to the mounting tube and as with the other aforementioned connections two tubular sleeves M22 are aligned with the holes near the top of the bars and a bolt M9, lock washer M10 and nut M11 are used to fasten the sleeves to the bars. The bars of the bracket are spaced so that there is about 3½" between the inner sides. Fastening straps of the same type as aforementioned are arranged to pass through each of the diagonal slots with the end of the strap containing the buckle abutting the slot. Extending past the bracket the mounting tube is fitted with a threaded axle M23 about 6" long. This axle passes through a rubber covered solid wheel M24 about 5" in Diameter and having a 9/16" hole for the axle. Lock washers M25 are placed on each side of the wheel and a nut M26 with an aperture on its circumference secures the wheel between the two washers. Cotter pin M27 is then inserted into the nut.

In the event that a plurality of bikes are used three chain cables M28 having hooks M29 at their ends are inserted into the bottom holes of the innermost of the bracket bars with respect to the mounting post. Each cable also has a spring M30 located adjacent one hook and so arranged that no two springs are attached to the same cable. A fourth cable has in addition to a spring located near one end of the cable a clevis M31 located in about the midpoint of the cable. The four cables are so arranged to form a parallelogram when viewed from the top.

To set up the roundabout the ground post is hammered into the ground with the earth being tamped around the post and checking to see that the post is perfectly vertical. About 34" of the ground post extends above the ground with the bottom of the bearing collar near ground level. Then the mounting post for the bikes is placed over the ground post up to the bearing collar and extending vertically about 34" from the top of the bearing collar. The crate-like bracket at the lower end of the mounting post is so placed that the center of the web of each plate of the bracked is about 2½" from the ground. The bottom assembly is first connected by aligning the tubular sleeve at the end of the mounting bar with the crate-like bracket on the post and inserting a bolt through the apertures of the flanges of one of the channel-like plates of the bracket and the sleeve and fastening the same with a bolt, lock washer and nut. Alternatively a quick bolt, quick nut and quick pin could be used as the fastening means. Then a washer is placed over the threaded axle of the mounting tube. The wheel is passed over the axle followed by another washer and a nut, which after tightening is further secured with a cotter pin inserted in the circumference of the nut. After this operation, attachment of the top mounting assembly commences with insertion of the horizontal element of the universal sleeve in the flanges of one of the channel like plates of the crate-like bracket at the top of the post, followed by securement with bolt, lock washer and nut. A similar attachment of the channel-like plate on the horizontal stabilizer tube over the vertical sleeve of the universal bearing is followed by fastening as described above. The yoke tube is now attached to the stabilizer tube by means of quick pin inserted through the aligned perforations. At this time the strap is inserted in the angular plate of the yoke tube and also the straps are inserted in the hold down bracket located on the mounting tube of the lower assembly. The strap inserted through the yoke plate is securely fastened to the bike shaft adjacent the handle bars. Then the bike front wheel is strapped in place on the mounting bracket. The straps can be arranged so that the buckle at the end of the strap is exteriorly of the angular yoke plate or on the interior. In the same way the buckles can be located either interiorly or exteriorly of the slots of the bars of the mounting brackets. The straps are so arranged that when pulled through the spokes of the bike wheel there will be hook and loop fastening surfaces facing each other so that the upper surface of the strap interlocks with the lower surface when pressed together. If after strapping of the bike at top and bottom it is not perfectly level, adjustment can be made by removing the quick pin at the top and moving the yoke tube either in or out until the bike is in satisfactory position.

The arrangement described above is for one bike. Obviously top and mounting assemblies would be required for each additional bike added. The cables while not necessary are preferable when a plurality of bikes is used. Each cable is hooked from one inner bar of the mounting bracket to the adjacent inner bar of a successive mounting bracket. Each of the cables is equipped with a spring that serves as a shock absorber and also a clevis is mounted on one cable for adjustment purposes. The motive power is supplied by the small wheel attached to the threaded axle of the lower mounting tube. When an individual applies pressure to the pedals, the rear wheel of the bike turns but since the front wheel is strapped in a fixed position, the wheel mounted on the axle turns and accordingly the upper post pivots around the ground mounted post.

The bike can be used by children or adults for exercise, amusement and for learning how to ride a bike. If desired, instead of mounting the roundabout on a level surface, it can be placed on a slope or a mount can be created in the path of the bike to simulate traveling up and down hills. When finished riding, the bikes can be easily disassembled by unfastening the straps and the bike can be taken in the house for storage. If a different location is desired, the mounting post can be lifted off the ground post, the ground post unearthed and moved to a desired spot.

While a preferred embodiment has been described, it should be understood that numerous modifications and changes will readily occur to those skilled in the art. It is not desired to limit the invention to the exact condition and operation shown and described. Accordingly, suitable modifications and equivalents can be resorted to fully compatible with the invention as claimed.

What is claimed is:

1. A roundabout comprising a ground fixed post having a vertical axis with a section firmly fixed in the ground and another section extending above the ground, a mounting post fitted over said another section of said ground post and rotatable about the axis of the fixed post, top and bottom mounting assemblies secured to said mounting post, said bottom mounting assembly comprising a channel-like plate fastened to the lower end of the mounting post, said channel-like plate comprising a web having apertured flanges extending away from said post, a mounting tube having a tubular sleeve on one end, said sleeve facing toward said channel-like plate and adapted to be inserted between said flanges in alignment with said apertures, means fastening said sleeve to said flanges and a mounting bracket secured on the top of said mounting tube and spaced a considerable distance outwardly from said mounting post, said mounting bracket comprising two vertically oriented bars having a top edge, a bottom edge and sides and spaced from each other, one of said bars being innermost with respect to said mounting post, each of said bars having two space slanted slots, said slots being oriented so that the lower ends of each slot face inwardly toward each other, a tubular sleeve for insertion between the apertures near the top edge and means fastening said sleeve between said bars, a strap having a buckle at one end and hook and loop fastening surfaces intermediate said one end and at a second end said strap being insertable in each slot in one bar and passing through said corresponding slot in said other bar with the buckle end secured at the face of the slot, said intermediate end fastening surface located between the bars on the top side, a front wheel of a bike having spokes placed on the sleeves of the mounting bracket and fastened to the mounting bracket by inserting said second end of the strap through the spokes of the wheel and bending the strap over so that the fastening surface on said top side mates with the fastening surface on said second end, said mounting tube having a threaded axle extending beyon the mounting bracket, said axle passing through a rubber covered wheel of small diameter as compared to the bike wheel and means fastening said rubber covered wheel on said axle.

2. A roundabout as in claim 1 where said sleeve fastening means includes a bolt, a lock washer and nut and wherein wheel fastening means includes washers on inner and outer sides of said wheel, a bolt and a nut said nut having an aperture on its circumference and a cotter pin oassing through said aperture.

3. A roundabout as in claim 1 wherein said top mounting assembly includes a channel-like plate having a web fastened to and near the top of the mounting post, an apertured flange facing away from the mounting post, a universal sleeve bearing having a horizontal member and a vertical member in the form of a cross wherein the horizontal member of said cross is inserted between the flanges of said channel-like plate, means fastening said sleeve between said flanges, a stabilizer tube having an apertured channel-like plate on an end of said tube facing said universal sleeve, said plate being oriented to be inserted over the vertical member of said universal sleeve and means fastening said sleeve to said oriented plate on said stabilizer tube, said stabilizer tube having a plurality of spaced perforations adjacent the other end of said tube, a yoke tube having a series of spaced perforations on one end that faces the end of the stabilizer tube and a quick pin for adjustably securing said stabilizer tube with said yoke tube when said tube is inserted into said stabilizer tube with the perforations aligned, the yoke of said tube having spaced slots, a strap covered with fastening material and having a buckle at one end, said strap being inserted into each of said slots and wrapped around the shaft of said bike below the handle bars with the fastening material of the strap being in opposing relationship.

4. A roundabout as in claim 1 wherein the mounting post has an aperture at the top located above said channel-like plate, an apertured cap fitted into the top of said mounting post with each said (is rture) aperture being aligned and secured with a cotter pin, said fastening means including a bolt, nut and washer.

5. A roundabout as in claim 1 wherein a plurality of apertures of said channel-like plates are secured to form a crate-like structure, said structure being secured at the top and bottom of said mounting post, said top and bottom mounting assemblies being fastened to said crate-like structure at each of the respective flanges of said plates.

6. A roundabout as in claim 5 wherein cables having hooks at each end are inserted into the lower edge aperture of (the inner bars) said innermost bar of the mounting brackets so as to form a parallelogram, each of said cables having a spring coaxially aligned in the cable.

7. A roundabout as in claim 6 wherein said cables are chain cables and one of said cables has a spring located at one end of the chain and a clevis located at about the midpoint of the chain and wherein each of said springs of said respective cables is located adjacent a hook each said hook and its adjacent spring being connected to a different mounting bracket.

8. A roundabout as in claim 1 wherein a clamping collar is secured around said ground post near the ground and said mounting post extends down to the mounting collar.

* * * * *